US005345652A

United States Patent [19]

Chuang

[11] Patent Number: 5,345,652

[45] Date of Patent: Sep. 13, 1994

[54] REFILL ERASER

[75] Inventor: Cheng-Hwa Chuang, Taipei, Taiwan

[73] Assignee: Pioneer Industrial Co., Taipei, Taiwan

[21] Appl. No.: 182,759

[22] Filed: Jan. 14, 1994

[51] Int. Cl.[5] ..... B43L 19/00

[52] U.S. Cl. ..... 15/425; 15/424; 15/433

[58] Field of Search ..... 15/424, 425, 426, 433, 15/434, 3.53

[56] References Cited

U.S. PATENT DOCUMENTS 2,465,597 3/1949 Marsh ..... 15/431
4,346,495 8/1982 Lin ..... 15/244.1

FOREIGN PATENT DOCUMENTS 2617094 12/1988 France ..... 15/424

*Primary Examiner*—Edward L. Roberts

*Attorney, Agent, or Firm*—Drucker & Sommers

[57] ABSTRACT

A refill eraser comprises at least one refill member. Each refill member includes a holding barrel having a partition portion and a plurality of rotation-preventive ridges formed on an inner peripheral surface of its front portion, and an eraser body having a generally frustro-conical front end portion, a cylindrical intermediate portion, and a cylindrical rear end portion. The eraser body is press-fitted into and held at its rear end portion and intermediate portion within the front portion of the holding barrel with its rear end portion and intermediate portion engaged with the ridges and with its rear end supported by the partition portion. The front end portion of the eraser body protrudes from the front end of the holding barrel. A plurality of the refill members are refillably held within an elongated tubular shaft. A front end of the eraser body located on the foremost end protrudes from a front end of the tubular shaft.

1 Claim, 2 Drawing Sheets

REFILL ERASER

BACKGROUND OF THE INVENTION

This invention relates to a refill eraser used for erasing letters, figures, etc., from a sheet of paper on which they are written.

Heretofore, erasers having various configurations are known. Among them, those commonly used have a flat parallelepiped configuration. A typical eraser used for technical drawing has a wooden shaft similar to that of a pencil, and a sand-contained eraser core which is bigger than a core of a pencil inserted or filled into the shaft over its entire length.

As discussed in Japanese Utility Model Publication No. Sho 51-32492, there is also known a refill pencil which comprises refill members each including a holding barrel and a pencil core whose rear end is fitted into a front end of the holding barrel having a smaller diameter, the refill members being longitudinally filled into and held within an elongated tubular shaft in engagement relation to each other.

In the commonly used flat parallelepiped erasers mentioned above, the letters, etc. written on a sheet of paper are erased therefrom, at an early stage of use, by rubbing the written surface with its four corner portions and four side portions (thus, with eight spots in total). However, since that portion of the eraser which contacts the paper surface is small in area, erasing efficiency is not good when the letters, etc., which are written in a large area, are to be erased. After an extended period of use, the corner portions are worn and therefore the contacting area relative to the paper surface becomes overly large. The result is that when letters, etc., which are written in a small area, are to be erased, there is a possibility that letters adjacent to the letters which are to be erased (that is, those letters which are not desired to be erased), are inadvertently erased.

With respect to the refill eraser having a wooden shaft and an eraser core filled therein, it has such a shortcoming that it is difficult to be used for other purposes than a special purpose for erasing a part of a device having a small size or the like. Moreover, since it is necessary to sharpen the wooden shaft, a troublesome work is required.

SUMMARY OF THE INVENTION

It is therefore an object of the present invention to provide, in order to overcome the above-mentioned shortcomings, a refill eraser which is comparatively simple in structure and yet capable of erasing letters, figures, etc. which are written on a middle-sized area even at an early stage of use, and continuously thereafter, with a favorable workability.

To achieve the above object, there is essentially provided a refill eraser comprising at least one refill member, the refill member including a holding barrel provided with a partition portion formed within a longitudinally central portion thereof and a plurality of rotation-preventive ridges spacedly formed on an inner peripheral surface thereof in a circumferential direction and extending longitudinally, and an eraser body having a cylindrical rear end portion and a tapered generally frustro-conical front end portion integrally formed with the rear end portion through a cylindrical intermediate portion, the eraser body being press-fitted into and held within a front portion of the holding barrel with the rear end portion and the intermediate portion engaged with the ridges and with a rear end of the eraser body abutted against the partition portion, a plurality of the refill members being refillably fitted into and held within an elongated tubular shaft as such that the holding barrels are respectively in abutment relation to front and rear ends of corresponding refill members, a front end of the eraser body of that refill member which is located on a foremost end being protruded from a front end of the elongated tubular shaft.

With the above-mentioned construction of the refill eraser according to the present invention, for erasing, the tubular shaft is held by one hand, and the letters, etc. written on a sheet of paper are erased with the front end portion of the eraser body which projects from the front end of the tubular shaft.

If the tubular shaft is made such that it has an outer diameter easy to use, the eraser body becomes to have a diameter generally equal to the shortest side of a conventional flat parallelepiped eraser but smaller than the remaining sides thereof. However, it becomes to have a diameter larger than that of an eraser core filled into a wooden shaft. These features, accompanied with the additional feature that the front end portion of the eraser body has a tapered generally frustro-conical configuration, enable to erase only the letters, devices, etc. on comparatively small-sized areas and also enable to erase the letters, etc. on middle-sized areas even at an early stage of use, and continuously thereafter.

When the front end portion of the eraser body of the refill member located on the foremost end is worn, the refill member at the foremost end is pulled out forwardly of the tubular shaft, and this refill member is pushed into the tubular shaft from the rear end thereof in order to push forward the second refill member (when counting from the front end) to the foremost end position so that it can be readily used. It is no more required to sharpen the wooden shaft to center the eraser core as often experienced in the prior art, and therefore a favorable workability is obtained.

Furthermore, since the cylindrical rear end portion of the eraser body of the refill eraser according to the present invention can be appropriately adjusted in length and in inner diameter depending on the hardness of the eraser body and elasticity of the holding barrel, the eraser body is not inadvertently escaped from the holding barrel and it does not get unstable, either. As a result, the refill eraser can positively be held during use. Moreover, since the rear end portion and the intermediate portion of the eraser body are engaged with the rotation-preventive ridges spacedly formed on the inner peripheral surface of the front portion of the holding barrel in such a manner as to extend longitudinally, the eraser body is not rotated relative to the holding body during use and therefore, it can be used conveniently. Owing to the foregoing arrangement, the refill members can easily be assembled simply by press-fitting the rear end portion of the eraser body into the front portion of the holding barrel.

Since the outer diameter of the holding barrel becomes slightly larger when the rear end portion and the intermediate portion of the eraser body are press-fitted, it is not necessary to provide a separate member or members to either the front end portion or the rear end portion of the tubular shaft, or both the front and rear end portions, as in the refill pencil mentioned above, and the holding barrel can be axially movably held with a required amount of resistance. As a result, it becomes comparatively simple in structure and does not become expensive.

DETAILED DESCRIPTION OF THE EMBODIMENT

One embodiment of the present invention will be described hereinafter with reference to the accompanying drawings.

Figure 1:
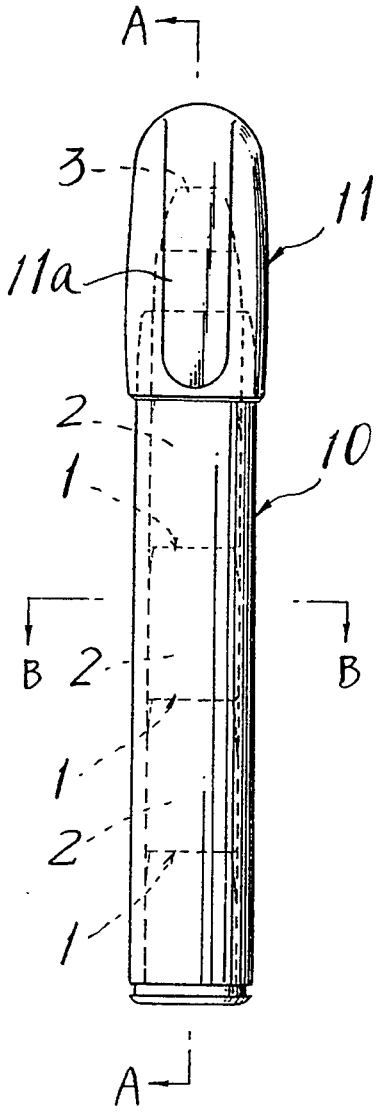
FIG. 1 is a front view showing a refill eraser according to one embodiment of the present invention.
Figure 2:
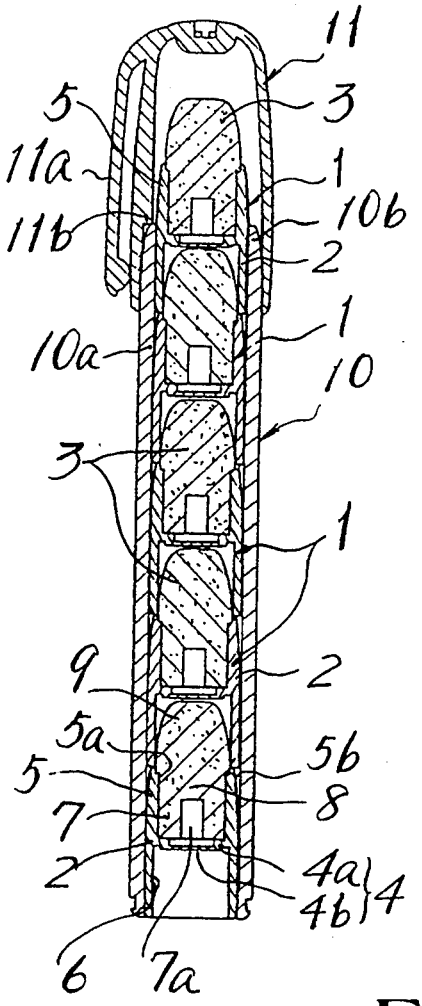
FIG. 2 is a sectional view taken on line A—A of FIG. 1.
Figure 3:
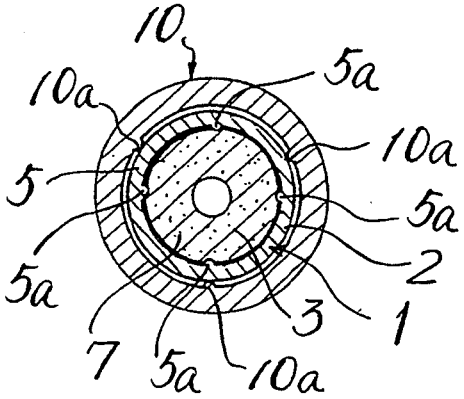
FIG. 3 is an enlarged sectional view taken on line B—B of FIG. 1.

In FIGS. 1, 2, and 3, reference numeral 1 denotes refill members each composed of a holding barrel 2 and an eraser body 3.

The holding barrel 2 is an integral molded-member formed of a colored synthetic resin material which is more or less elastic. A partition portion 4, which includes an annular member 4*a* projecting inwardly of its inner peripheral surface and a reticular reinforcement member 4*b* connected to a rear surface of the annular member 4*a* on the center side, is formed within a longitudinally central portion of the holding barrel 2.

Four rotation-preventive ridges 5*a* are equally spacedly formed on the inner peripheral surface of the front portion 5 of the holding barrel 4 in a circumferential direction of the holding barrel. An outer peripheral surface 5*b* of the front portion 5 of the holding barrel 2 is tapered such that its wall portion is gradually reduced in thickness toward the front end. A rear portion 6 of the holding barrel 2 is formed such that its inner diameter is slightly larger than the inner diameter of the front portion 5.

The eraser body 3 has a cylindrical rear end portion 7 which is provided with a center cavity 7*a* open to its rear end. A tapered generally frustro-conical front end portion 9 having a rounded front edge is integrally formed with the eraser body 3 on the front side of the rear end portion 7 through a cylindrical intermediate portion 8. The rear end portion 7 and the intermediate portion 8 are coaxial with each other and equal in outer diameter with each other.

The rear end portion 7 and the intermediate portion 8 of the eraser body 3 are press-fitted into and held within the front portion 5 of the holding barrel 2. Also, the rear end portion 7 and the intermediate portion 8 of the eraser body 3 are engaged with the rotation-preventive ridges 5*a* so that the eraser body 3 may not rotate relative to the holding barrel 2. The front end portion 9 of the eraser body 3 projects forwardly of the holding barrel 2.

The eraser body 3 is designed such that its overall length is about 18 mm, its rear and intermediate portions are about 9 mm in diameter, its front end face is about 5 to 6 mm in diameter, and its center cavity 7*a* is about 3 mm in diameter and about 4.5 mm in depth. In case the eraser body 3 is hard or in other similar cases, longitudinal grooves may be beforehand formed in the outer periphery of the rear and intermediate portions 7 and 8, so that the rotation-preventive ridges 5*a* can engage them.

The refill member 1 thus constructed includes the holding barrel 2 and the eraser body 3 having the same or similar color with respect to each other. Five kinds of refill members 1 are prepared, each having a different color from that of the remaining four. More specifically, in the first kind of refill member 1, the color of the holding barrel 2 is the same or similar to that of the eraser body 3. Likewise, in the second kind of refill member 1, the color of the holding barrel 2 is the same or similar to that of the eraser body 3. However, the color of the holding barrel 2 and the eraser body 3 of this second kind of refill member 1 is different from that of the holding barrel 2 and the eraser body 3 of the first kind of refill member 1. The same is true to other three kinds of refill members 1 (namely, third to fifth refill members). The five refill members 1 each having a different color are refillably fitted into and held within an elongated tubular shaft 10.

The tubular shaft 10 is formed of an integral molded-member of a transparent synthetic resin material which is more or less elastic. Three holding ridges 10*a* each longitudinally extending nearly up to its rear end from its front end are formed at equal spaces on its inner peripheral surface in the circumferential direction. A front end portion 10*b* of the outer peripheral surface of the tubular shaft 10 is tapered such that a wall portion of the front end portion 10*b* is reduced in thickness toward the front end.

The five refill members 1 are filled into the elongated tubular shaft 10 such that they are longitudinally arranged therein, with the outer peripheral surface of the rear portion 6 of each holding barrel 6 held by the holding ridges 10*a*, and with the longitudinally adjacent holding barrels 2 abutted against each other. The front end portion 9 of each eraser body 3 projecting from the front end of the holding barrel 2 on the rear side is loosely fitted into the rear portion 6 of the holding barrel 2 on the front side. The rear end of the holding barrel 3 of the refill member 1 at the rearmost end is flush with the rear end of the tubular shaft 10, and the whole or a part of the front portion 5 of the holding barrel 2 provided to the refill member 1 at the foremost end projects from the front end of the tubular shaft 10. In that state, the respective refill members 1 cannot move longitudinally and cannot rotate about the longitudinal axis, either, unless a force of more than a predetermined amount is applied thereto.

A cap is removably fitted onto the front end portion of the tubular shaft 10. The cap 11 is formed of an integral molded-member of a transparent synthetic resin material which is similar in quality as the tubular shaft 10. The cap 11 includes a clip 11*a* formed on its outer peripheral surface and a stopper 11*b* formed on its inner peripheral surface in such a manner as to be held opposite to the clip 11*a*. When the tubular shaft 10 is fitted into the cap 11, the front end of the tubular shaft 10 is brought into abutment with the stopper 11*b*, so that the cap 11 is prevented from being not detached from the tubular shaft 10 due to overly long fitting length, and the front end of the eraser body 3 of the refill member 1 at the foremost end is prevented from being abutted against the inner surface of the front end portion of the cap 11.

With the refill eraser thus constructed, the cap 11 is removed from the tubular shaft 10, and the letters, devices, etc. written with a pencil are erased with the front end portion 9 of the eraser body 9 provided to the refill member 1 on the foremost end. In that case, the user holds the tubular shaft 10 with his/her fingers and rubs the area of the sheet of paper on which the letters, etc. are written. Since the eraser body 3 is press-fitted at its rear end portion 7 and its intermediate portion 8 into the front end 5 of the holding barrel 2 and elastically deformed, it is positively held within the holding barrel 2 under the influence of the restoring force. Since the rear end portion 7 and the intermediate portion 8 are engaged with the rotation-preventive ridges 5*a* formed on the inner peripheral surface of the holding barrel 2, the eraser body 3 is not rotated about the axis relative to the holding barrel 2.

Since the eraser body 3 is formed into a cylindrical configuration having the center cavity 7*a* in the rear end portion 7, the amount of elastic deformation can be increased, the eraser body 3 can positively be prevented from escaping, and the rotation can positively be prevented. Moreover, even if the amount of elastic deformation of the rear end portion 7 is increased, the eraser body 3 is not inadvertently moved in the escaping direction relative to the holding barrel 2 when an external force directing outwardly is not applied, because the amount of elastic deformation of the front end portion 5 of the holding barrel 2 expanding toward the outer peripheral side is small.

If the outer diameter of the tubular shaft 10 is set to about 15 mm, the eraser body 3 becomes at the rear and intermediate portions 7 and 6 about 9 mm in diameter. Since the front end portion 9 is formed into a generally frustro-conical configuration and the diameter is appropriately large compared with the conventional wooden shaft in which about 4 mm eraser core is filled, the letters, devices, etc. written on middle-sized areas can be erased even at an early stage of use, and continuously thereafter, with a favorable workability.

Even if the front end portion 9 of the eraser body 3 is worn to become short by use, the front end portion 5 of the holding barrel 2 and the front end portion 10*a* of the tubular shaft 10 are not caught by the paper, etc. because these portions are tapered, thus ensuring a smooth use.

When the front end portion 9 of the eraser body 3 provided to the refill member 1 at the foremost end is worn, this refill member 1 is pulled out forwardly of the tubular shaft 10. Then, the pulled-out refill member 1 is pushed into the tubular shaft 10 from its rear end in order to push forward the holding members 2 of the respective refill members 1 until the refill member 1 located in a second position from the front end comes to the foremost end position of the tubular body 10. Also for the remaining refill members 1, the same procedure is repeated every time the front end portion 9 of the eraser body 3 is worn.

When the front end portions 9 of the eraser bodies 3 of all the refill members 1 have been worn out, the eraser body 3 of the holding barrel 2 of each refill member 1 is replaced by a new eraser body 3, or the refill member including the eraser body 3 which has been worn out is replaced by a new eraser body 1. By refilling this new eraser body 1 into and held within the tubular shaft 10, a long-life use is ensured.

When a brand new refill eraser or eraser body 3 is not in use, the eraser body 3 can be protected from dust, etc. simply by fitting the cap 11 onto the front end portion 10*a* of the tubular shaft 10.

In this embodiment, the tubular shaft 10 and the cap 11 are formed of a transparent material, and the holding barrel 2 and the eraser body 3 of each refill member 1 is arranged to be the same or similar in color. And the five refill members 1 having such five different colors as pink, orange, yellow, green and blue are longitudinally arranged within the tubular shaft 10. Accordingly, the respective refill members 1 can be seen from outside through the tubular shaft 10 or through the cap 11, and therefore an attractive appearance is obtainable. In the case where five kinds of refill members 1 are prepared paying attention to difference in material of the eraser bodies 3 such as a hard material, a soft material, etc., the material of one eraser body 3 can be distinguished from those of the remaining eraser bodies 3 by applying different colors thereto.

The number of the refill members of the present invention is not limited to five, and it can be changed in a range of from several to about a dozen. The size of each eraser body can appropriately be changed. For general use, however, the size of each eraser body is preferably in the range mentioned with respect to the above embodiment. The material of each eraser body can also be changed appropriately, such as hard material, soft material, etc. Also, in accordance with necessity, a combination of a hard material, a soft material and a sand-contained material may be adopted, and five refill members formed of such materials may be arranged within a single tubular shaft, so that they can be selectively used depending on the user's taste, kinds of writing devices with which the letters, figures, etc. are written on a sheet of paper, material of paper, etc.

As described in the foregoing, a refill eraser according to the present invention comprises at least one refill member, the refill member including a holding barrel provided with a partition portion formed within a longitudinally central portion thereof and a plurality of rotation-preventive ridges spacedly formed on an inner peripheral surface thereof in a circumferential direction and extending longitudinally, and an eraser body having a cylindrical rear end portion and a tapered generally frustro-conical front end portion integrally formed with the rear end portion through a cylindrical intermediate portion, the eraser body being press-fitted into and held within a front portion of the holding barrel with the rear end portion and the intermediate portion engaged with the ridges and with a rear end of the eraser body abutted against the partition portion, a plurality of the refill members being refillably fitted into and held within an elongated tubular shaft as such that the holding barrels are respectively in abutment relation to front and rear ends of corresponding refill members, a front end of the eraser body of that refill member which is located on a foremost end being protruded from a front end of the elongated tubular shaft. Accordingly, the following effects can be obtained.

In the refill eraser according to the present invention, for erasing, the tubular shaft is held by one hand, and the letters, etc. written on a sheet of paper are erased with the front end portion of the eraser body which projects from the front end of the tubular shaft.

If tubular shaft is made such that it has an outer diameter easy to use, the eraser body becomes to have a diameter generally equal to the shortest side but smaller than the remaining sides of a conventional flat parallelepiped eraser. However, it becomes to have a diameter larger than that of an eraser core filled into a wooden shaft. These features accompanied with the additional feature that the front end portion of the eraser body has a tapered generally frustro-conical configuration, enable to erase only the letters, devices, etc. on comparatively small-sized areas and also enable to erase the letters, etc. on middle-sized areas even at an early stage of use, and continuously thereafter.

When the front end portion of the eraser body of the refill member located on the foremost end is worn, the refill member at the foremost end is pulled out forwardly of the tubular shaft, and this refill member is pushed into the tubular shaft from the rear end thereof in order to push forward the second refill member (when counting from the front end) to the foremost end position so that it can be readily used. It is no more required to sharpen the wooden shaft to center the eraser core as often experienced in the prior art, and therefore a favorable workability is obtained.

Furthermore, since the cylindrical rear end portion of the eraser body of the refill eraser according to the present invention can be appropriately adjusted in length and in inner diameter depending on the hardness of the eraser body and elasticity of the holding barrel, the eraser body is not inadvertently escaped from the holding barrel and it does not get unstable, either. As a result, the refill eraser can positively be held during use. Moreover, since the rear end portion and the intermediate portion of the eraser body are engaged with the rotation-preventive ridges spacedly formed on the inner peripheral surface of the front portion of the holding barrel in such a manner as to extend longitudinally, the eraser body is not rotated relative to the holding body during use and therefore, it can be used conveniently. Owing to the foregoing arrangement, the refill members can easily be assembled simply by press-fitting the rear end portion of the eraser body into the front portion of the holding barrel.

Since the outer diameter of the holding barrel becomes slightly larger when the rear end portion and the intermediate portion of the eraser body are press-fitted, it is not necessary to provide a separate member or members to either the front end portion or the rear end portion of the tubular shaft, or both the front and rear end portions, as in the refill pencil mentioned above, and the holding barrel can be axially movably held under a required amount of resistance. As a result, it becomes to have a comparatively simple structure and is not expensive.

Although only one preferred embodiment has been described in detail, the present invention is not limited to this embodiment and various modifications can be made without departing from the scope of the appended claim.

What is claimed is:

1. A refill eraser comprising at least one refill member, said refill member including a holding barrel provided with a partition portion formed within a longitudinally central portion thereof and a plurality of rotation-preventive ridges spacedly formed on an inner peripheral surface thereof in a circumferential direction and extending longitudinally, and an eraser body having a cylindrical rear end portion and a tapered generally frustro-conical front end portion integrally formed with said rear end portion through a cylindrical intermediate portion, said eraser body being press-fitted into and held within a front portion of said holding barrel with said rear end portion and said intermediate portion engaged with said ridges and with a rear end of said eraser body abutted against said partition portion, a plurality of said refill members being refillably fitted into and held within an elongated tubular shaft as such that said holding barrels are respectively in abutment relation to front and rear ends of corresponding refill members, a front end of said eraser body of that refill member which is located on a foremost end being protruded from a front end of said elongated tubular shaft.

* * * * *